US009971308B2

(12) United States Patent
Chevallier et al.

(10) Patent No.: US 9,971,308 B2
(45) Date of Patent: May 15, 2018

(54) STONE MOUNTED ON A SPRING ELEMENT

(71) Applicant: Cartier International Ag, Steinhausen (CH)

(72) Inventors: Gabriel Chevallier, Allinges (FR); Kewin Bas, Villers-le-Lac (FR); Sebastien Jouvenot, Concise (CH); Romain Moyse, Montlebon (FR)

(73) Assignee: Cartier International AG (CH)

( * ) Notice: Subject to any disclaimer, the term of this patent is extended or adjusted under 35 U.S.C. 154(b) by 0 days. days.

(21) Appl. No.: 15/110,453

(22) PCT Filed: Jan. 7, 2015

(86) PCT No.: PCT/EP2015/050172
§ 371 (c)(1),
(2) Date: Jul. 8, 2016

(87) PCT Pub. No.: WO2015/113788
PCT Pub. Date: Aug. 6, 2015

(65) Prior Publication Data

US 2016/0327912 A1 Nov. 10, 2016

(30) Foreign Application Priority Data

Jan. 31, 2014 (EP) ..... 14153533

(51) Int. Cl.
*G04B 47/04* (2006.01)
*A44C 17/02* (2006.01)

(52) U.S. Cl.
CPC ..... *G04B 47/042* (2013.01); *A44C 17/0275* (2013.01)

(58) Field of Classification Search
CPC ..... G04B 47/042; A44C 17/00; A44C 17/02; A44C 17/0258; A44C 17/0266; A44C 17/0275; A44C 9/02
(Continued)

(56) References Cited

U.S. PATENT DOCUMENTS 770,880 A * 9/1904 Weiss ..... A44B 1/40 24/112
4,187,697 A * 2/1980 Castelo ..... A44C 17/0275 63/15
(Continued)

FOREIGN PATENT DOCUMENTS

EP 2510824 A1 10/2012
RU 100367 U1 12/2010
WO WO-2012/115458 A2 8/2012

OTHER PUBLICATIONS

International Search Report of PCT/EP2015/050172, dated Apr. 16, 2015, 2 pages.

*Primary Examiner* — Edwin A. Leon
*Assistant Examiner* — Jason Collins
(74) *Attorney, Agent, or Firm* — Blank Rome LLP

(57) ABSTRACT

A crimping system (1) for a timepiece (6) or jewelry item comprising: a crimping support (3); a precious stone (2) mounted in or on the crimping support (3); and a flexible element (5) fastened to the crimping support (3) in such a way as to flexibly link the crimping support (3) to said item (6), such that the stone (2) can oscillate axially and radially relative to an axis of symmetry (15), following a movement of the item (6); the crimping system (1) further comprising a stop (18, 22) that is more rigid than the flexible element (5), the stop (18, 221, 241) being capable of cooperating with the crimping support (3), in such a way as to limit the range of axial and/or radial movement of the stone (2) when the latter oscillates. In particular, the crimping system (1) has the advantage, relative to the prior art, of allowing much easier and more reliable mounting of the stone (2) and of being better suited to the use of stones (2) of small dimensions.

24 Claims, 8 Drawing Sheets

(58) Field of Classification Search
USPC ..... D11/16, 89
See application file for complete search history.

(56) References Cited

U.S. PATENT DOCUMENTS

| | | | | | |
|---|---|---|---|---|---|
| 5,400,304 | A * | 3/1995 | Offenstein | G04B 19/106 | 368/281 |
| 6,164,292 | A * | 12/2000 | Di Maria Poole | A44C 17/0216 | 132/273 |
| 6,226,232 | B1 * | 5/2001 | Ruchonnet | A44C 17/0291 | 351/51 |
| 6,433,483 | B1 | 8/2002 | Michael et al. | | |
| 8,974,113 | B1 * | 3/2015 | Chan | G04B 45/0076 | 368/285 |
| 2013/0070573 | A1 * | 3/2013 | Oshio | G04B 47/042 | 368/235 |

* cited by examiner

STONE MOUNTED ON A SPRING ELEMENT

RELATED APPLICATIONS

This application is a national phase of PCT/EP2015/050172, filed on Jan. 7, 2015 which claims priority to European Patent Application No. 14153533.6 filed on Jan. 7, 2014. The contents of the applications are hereby incorporated by reference.

TECHNICAL FIELD

The present invention concerns a crimping system for a timepiece or jewelry item wherein a precious stone is mounted so as to give a visual effect of the stone vibrating. The present invention also concerns a watch dial and a timepiece or jewelry item comprising such a crimping system.

STATE OF THE ART

In U.S. Pat. No. 6,433,483, a jewelry item comprises diamonds being illuminated with the aid of a light source. A controller controls the light source so as to vary the intensity of the light emitted by the source, thus enabling the optical effects of the diamond to be more enhanced. It is however often undesirable to use electronic devices in high-end timepieces or jewelry items.

Document EP2510824 describes a jewelry item comprising a precious stone fastened in a setting mounted on a pivot element of plastic or elastomer. Although the stone-setting unit can move, its movement on the pivot element does not provide a visual effect of the stone vibrating.

Utility model RU100367U describes a jewelry item comprising a precious stone fastened in a disc-shaped setting, this stone-setting unit being connected to a base of the item by a cylindrical spring. The vibration of the stone mounted on the spring causes a light refraction effect. Fastening the ends of the spring to the setting and to the base is however complicated and delicate. In the case of small springs, required in the case of small-size stones, the latter can deform excessively when the stone moves relative to its initial position, negatively affecting the stone's vibration movement and thus the item's aesthetic aspect. Furthermore, the sizing of the spring so as to obtain the desired visual effect makes it fragile and the spring can also become irreversibly deformed by shocks.

Patent application WO2012/115458 describes a jewelry item comprising a ring-shaped support having a hollow sector in which a setting is mounted using a spiral or conical spring. The extremities of the spring are fastened in grooves made in the support respectively in the setting, and the setting is made to oscillate under the effect of external excitations on the support. According to one embodiment, a pin is mounted through the upper part of the setting, wherein each of the extremities of the pin is lodged in the support in a plane parallel to the plane of the spring (the spring being fastened to a lower part of the setting). The pin serves to prevent the setting and the support from separating in the case of serious shocks. According to this document, with this construction, the lower part of the setting can only vibrate in a direction perpendicular to the pin in the plane of the spring, and the upper part of the setting remains effectively integrally united with the support.

Although such an item is less likely to accidentally separate from the setting and/or for the spring to deform following a serious shock, the oscillations of the setting are much too limited by the pin that significantly absorbs them continuously. This consequently denies the item's desired visual effect or even the vibration or movement of the stone. Furthermore, even after a stone has been mounted in the setting, the spring and the pin remain completely visible to the item's wearer, which considerably tarnishes the aesthetic aspect of the jewelry item.

BRIEF SUMMARY OF THE INVENTION

One aim of the present invention is to propose a crimping system for a timepiece or jewelry item free from the limitations of the known state of the art.

Another aim of the invention is to obtain a crimping system allowing much easier and more reliable mounting of the stone as compared with the known systems and better suited to the use of stones of small dimensions.

According to the invention, these aims are achieved notably by means of a crimping system for a timepiece or jewelry item comprising a crimping support, a precious stone mounted in or on the crimping support, and a flexible element fastened to the crimping support in such a way as to flexibly link the crimping support to said item, such that the crimping support, and thus the stone, can oscillate axially and radially relative to an axis of symmetry, following a movement of the item. The crimping system further comprises a stop that is more rigid than the flexible element, the stop being capable of cooperating with the crimping support, in such a way as to limit the range of axial and/or radial movement of the crimping support when the latter oscillates.

Particular embodiments and variants are described in the dependent claims.

The present invention also concerns a dial of a timepiece as well as a timepiece or jewelry item comprising said crimping system.

BRIEF DESCRIPTION OF THE FIGURES

Examples of embodiments of the invention are indicated in the description illustrated by the attached figures in which.

EXAMPLE(S) OF EMBODIMENTS OF THE INVENTION

Figure 1:
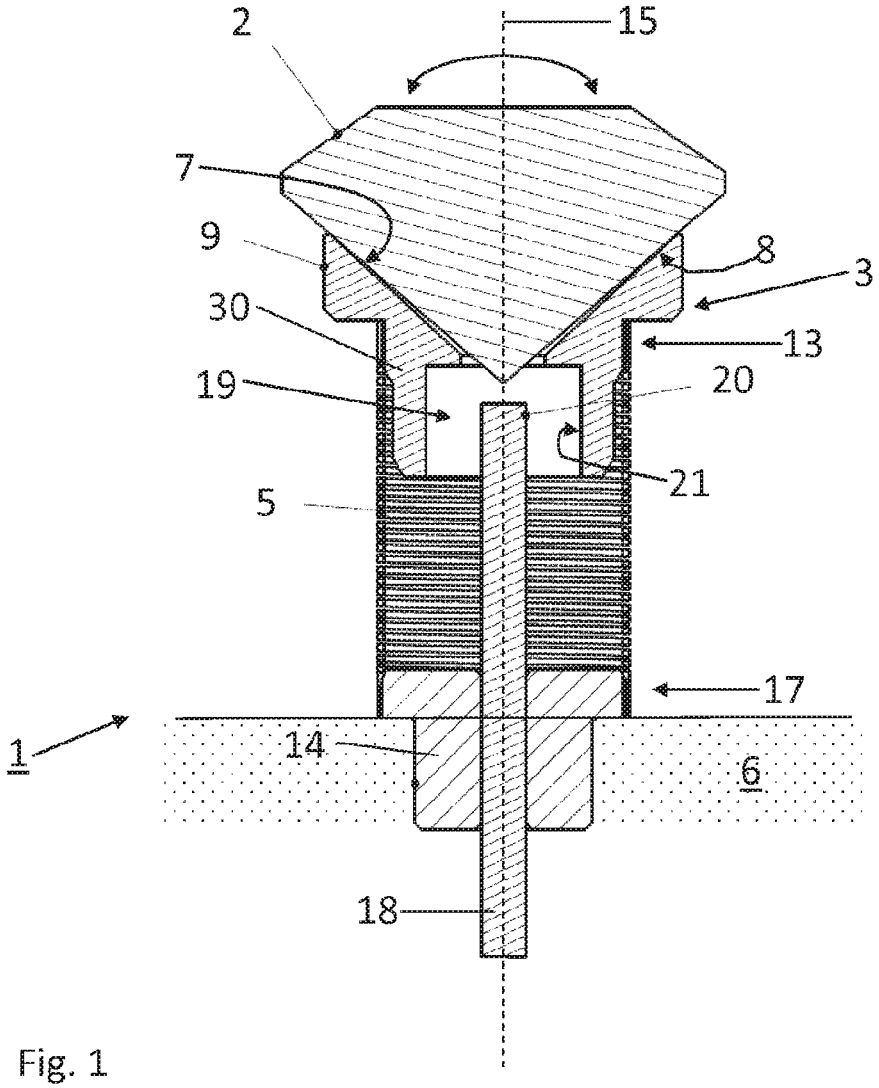
FIGS. 1 and 2 show a cross section view of a crimping system comprising a crimping support for a timepiece or jewelry item, according to one embodiment.
Figure 2:
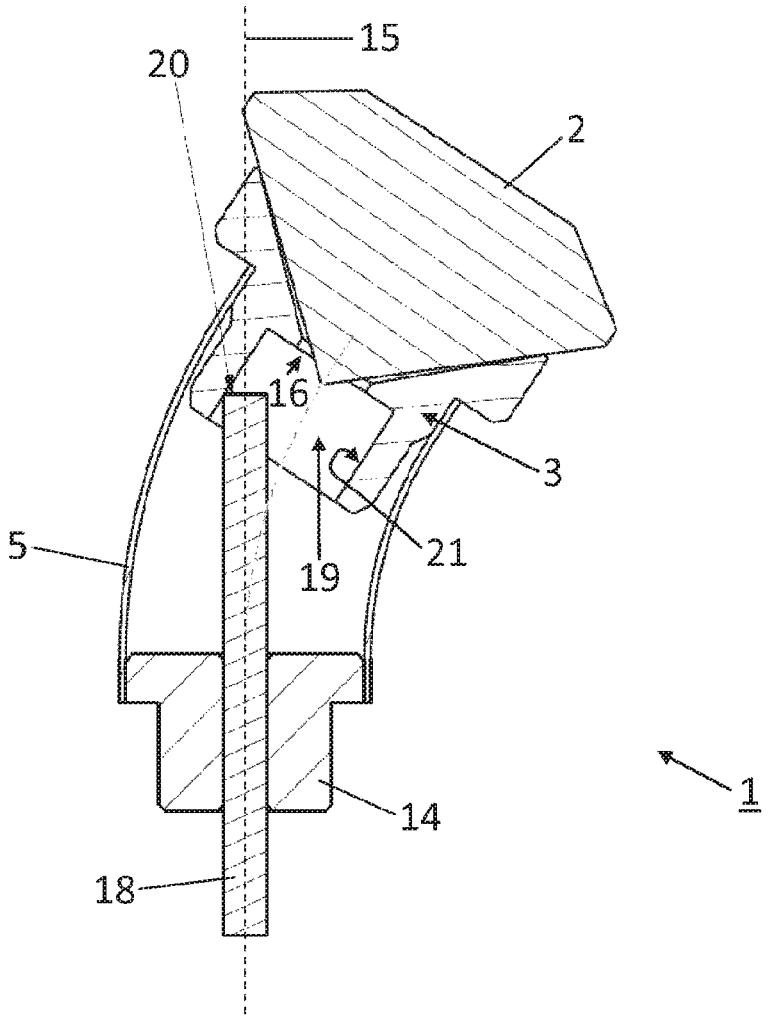

FIGS. 1 and 2 show a cross section view of a crimping system 1 for a timepiece or jewelry item 6, according to one embodiment. The crimping system 1 comprises a crimping support 3, or setting, in which a precious stone 2 is mounted, such as a diamond, ruby, sapphire or emerald. It will be understood here that the expression "a precious stone" means at least one precious stone 2, wherein the support 3 can support a plurality of precious stones 2. In the example of FIGS. 1 and 2, the crimping support 3 comprises a front part 9 in the shape of a truncated cone and serves as a seat for the culasse 8 of the stone 2. The inclination of the profile 7 of the front part 9 is arranged so as to ensure the culasse 8 is held. The support 3 can also comprise a boring 16 coaxial with the support 3.

The crimping system 1 also comprises a flexible element 5 of which a first extremity 13 is fastened to the crimping support 3 and the other extremity 17 to the timepiece or jewelry item 6. In this arrangement, the flexible element 5 elastically connects the crimping support 3 with the stone 2 to the item 6, so that the stone 2 can oscillate or vibrate on the flexible element 5 following a movement of the item 6 (in other words, so that the crimping support, and thus the stone, can oscillate or vibrate on the flexible element 5 following a movement of the item 6). For example, during a shock or sudden movement of the timepiece or jewelry item 6 comprising the crimping system 1, the extremity 17 of the flexible element 5 attached to the item 6 remains fixed (relative to the item), whilst the rest of the flexible element 5 deforms elastically under the effect of the acceleration of the mass of the stone 2 and of the crimping support 3. The stiffness of the flexible element 5, the mass of the stone 2 and of the crimping support 3 as well as the intensity of the shock are the main factors defining the amplitude of the vibrations (or oscillations) of the stone 2. In such an arrangement, the oscillation of the stone 2 occurs according to a radial movement relative to an axis of symmetry 15 and an axial movement relative to this same axis 15. It will however be noted that the amplitude of the axial movements along the axis 15 is low by comparison with the radial movements along this same axis.

The crimping system 1 further comprises a stop 18 more rigid than the flexible element 5 and arranged to cooperate with the crimping support 3 so as to limit the amplitude of the axial and/or radial movement of the stone 2 (in other words, so as to limit the amplitude of the axial and/or radial movement of the crimping support and thus of the stone mounted in the crimping support 3) when the latter oscillates. Depending on its material and its thickness, the stop can be rigid or it can be slightly elastic. In other words, the stop has a second stiffness $K_2$ greater than the first stiffness $K_1$ of the flexible element 5.

In the present description, the expression "proximal" means on a side close to the stone 2 and the expression "distal" means on a side further away from the stone 2. The expression "radial" corresponds to a plane perpendicular to the axis of symmetry 15. For example, a radial movement corresponds to a lateral displacement relative to the axis of symmetry 15, thus towards the left or the right in FIGS. 1 and 2. The expression "axial" corresponds to a plane parallel to the axis of symmetry 15. For example, an axial movement corresponds to a displacement oriented along the axis of symmetry 15, thus from top to bottom in FIGS. 1 and 2.

In the particular embodiment illustrated in FIGS. 1 and 2, the flexible element comprises a cylindrical spring 5 having the shape of a tube. The crimping support 3 comprises a peg 30 integrally united with the crimping support 3 and housed, at least partly, in a first extremity 13 of the spring 5, so as to fasten the peg 30 to the flexible element 5 by tightening. The second extremity 17 of the spring 5 is fastened in the item 6 by at least one of the methods comprising tightening, driving, clipsing or welding, or also any other suitable method. The stop takes the shape of a rod 18 lodged concentrically in the cylindrical spring 5. The rod 18 extends over at least one part of the length of the cylindrical spring 5 and preferably nearly all of this length. The proximal extremity 20 of the rod 18 cooperates with the crimping support 3 that serves as counter stop when the stone 2 (mounted in the crimping support 3) is made to oscillate. The second extremity 17 of the spring 5 is fastened to the item 6 by means of a pin 14. The pin 14 is fastened, for example by driving or screwing, in the item 6 and the second extremity 17 of the spring 5 is fastened, for example by tightening, on the pin 14. The distal extremity of the rod 18 passes through a hole in the pin 14 and is fastened to the support 6 by a suitable method, such as driving, tightening or clipsing.

The crimping support 3, in this case the peg 30, comprises a recess 19 into which the proximal extremity 20 of the rod 18 extends. As shown in FIG. 2, during the oscillation of the stone 2, the amplitude of the radial movement of the stone 2 is limited by the proximal extremity 20 of the rod 18 stopping against an internal wall 21 of the recess 19.

Advantageously, the rod 18 does not come into contact with the crimping support 3 when the latter is in its resting position or when it is subjected only to shocks below a certain threshold. By selecting the size of the recess and the size of the rod in a suitable manner for a given flexible element 5, it is possible to ensure that the rod 18 stops against the wall 21 when a shock is above a threshold at which a permanent deformation of the flexible element 5 can occur. Consequently, the crimping support 3 bearing the stone 2 can oscillate or vibrate freely as long as there is no risk of damaging the system.

In the embodiment of FIGS. 1 and 2, the cylindrical spring 5 generally comprises at least one spire on one portion of its length, for example in the middle of the spring 5. The spring 5 can also comprise spires in the vicinity of the two extremities 13, 17 of the spring 5 and spires in a portion between the two extremities 13, 17. The spires in the vicinity of the two extremities 13, 17 can have a height much greater than the spires comprised in the portion of the spring 5 situated between the two extremities 13, 17. The spring 5 can be made of a metal or plastic using a laser cutting process or any other suitable process.

Figure 3:
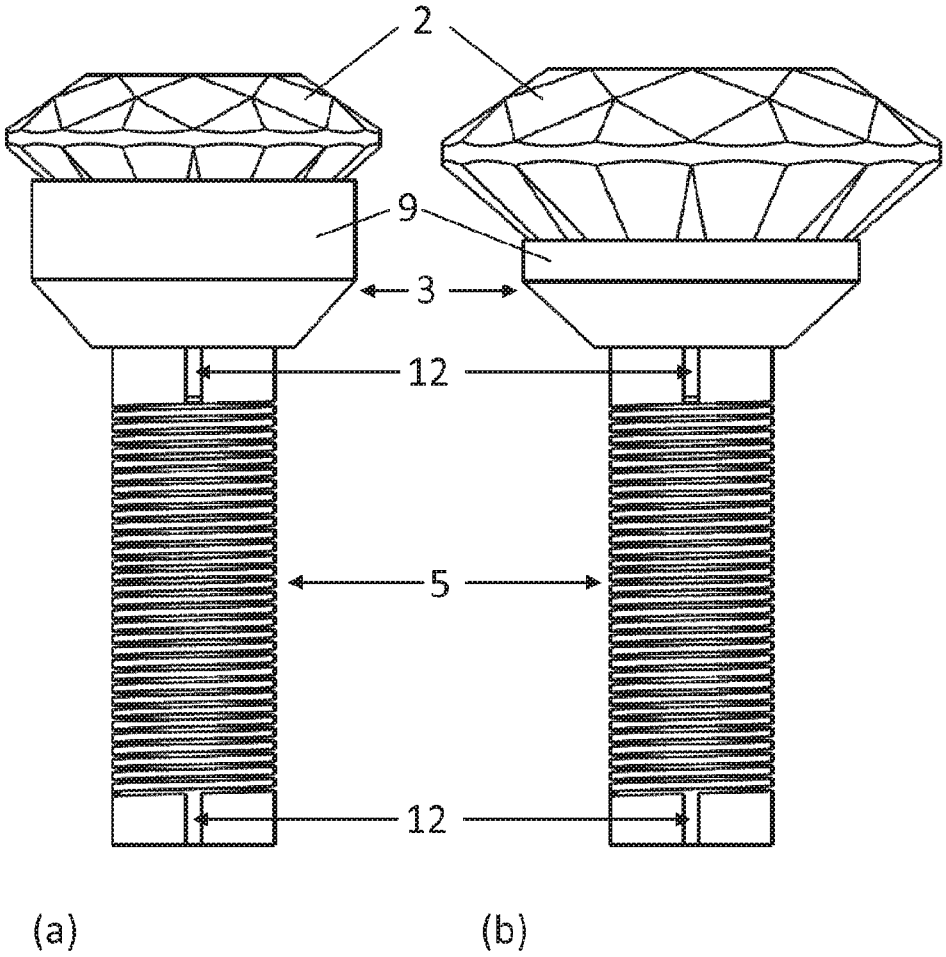
FIG. 3 illustrates the crimping system according to another embodiment.

According to an embodiment illustrated in FIG. 3, the first extremity 13 of the spring 5 comprises a cutaway 12, or elasticity slit, enabling at least part of the driving effort of the peg 30 to be absorbed radially by elastic and/or plastic deformation. Such a cutaway 12 can also be provided at the second extremity 17 of the spring 5, for example to facilitate the driving, when the spring 5 is driven in the pin 14.

Advantageously, according to other embodiments, the same one stop element of the crimping system can be capable of cooperating with the crimping support so as to limit the amplitude of the radial movement and the amplitude of the axial movement of the crimping support 3.

Figure 8:
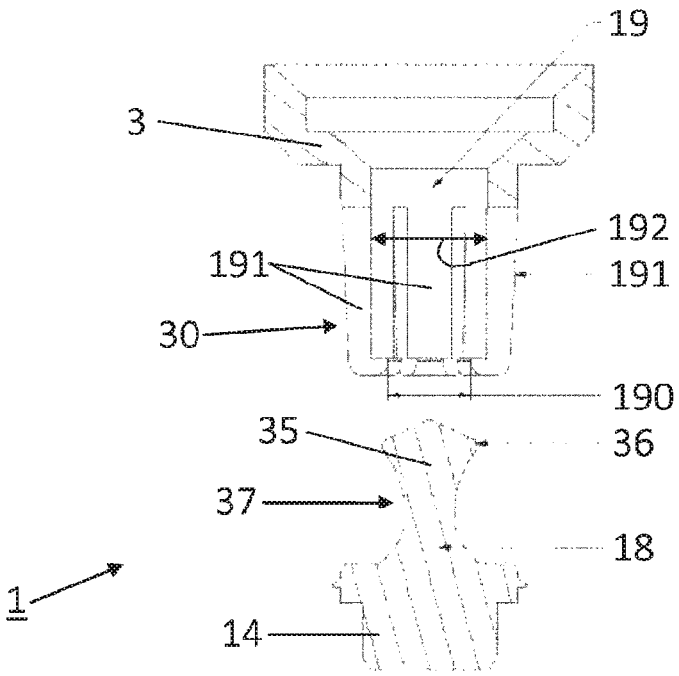
FIG. 8 represents an exploded sectional view of the crimping system according to another embodiment.
Figure 9:
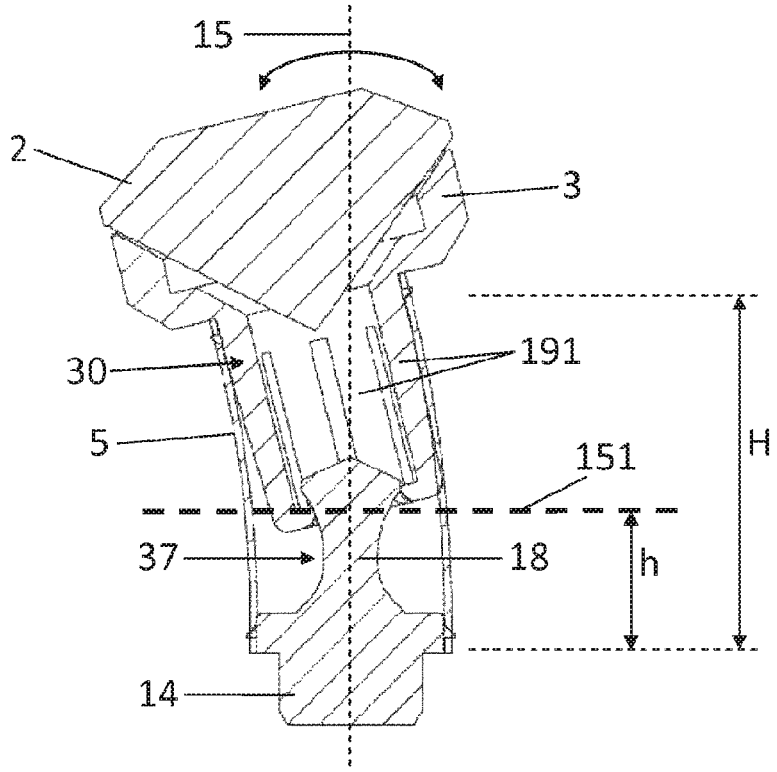
FIG. 9 shows the crimping system of FIG. 8 with the crimping support oscillating.

According to another embodiment illustrated in FIGS. 8 and 9, the internal wall 21 comprises radially deformable fins 191. At the distal extremity of the peg 30, the fins 191 form a distal opening 190. On the other hand, the rod 18 comprises a proximal head 35 having a diameter that decreases distally. The greatest diameter 36 of the proximal head 35 is smaller than the diameter 190 of the cavity 19 but greater than the diameter of the distal opening 190. The proximal head 35 can thus be inserted into the cavity 19 from the distal opening 190 through deformation of the fins 191. Once the proximal head 35 is inserted into the cavity 19, it stops against the fins 191 when the crimping support 3 is subjected to shocks exceeding the threshold. In this configuration, the radial displacement of the crimping support 3 is thus limited by the axial fins 191 stopping against the proximal head 35. At the same time, the axial displacement of the crimping support 3 is also limited by the distal extremities of the fins 191, which are generally in the shape of an "L", stopping against the proximal head 35.

In the configuration illustrated at FIGS. 8 and 9, the proximal head 35 and the rod 18 are formed integrally with the pin 14. The rod 18 has a concave shape corresponding to the diameter of the proximal head 35 decreasing distally.

The proximal head 35 and the fins 191 can be sized so that when the proximal head 35 is inserted into the cavity 19, the the axis of rotation of the crimping support 3 on the proximal head 35 (represented by the number 151 in FIG. 9) is as low as possible. In FIG. 9, this axis of rotation 151 is shown at approximately one third of the total height H of the spring 5. In other words, the ratio of the distance h between the distal opening 190 and the length of the spring 5 is about one third. Preferably, the ratio of the distance h over the total height H of the spring 5 is approximately one quarter, or even less.

Figure 10:
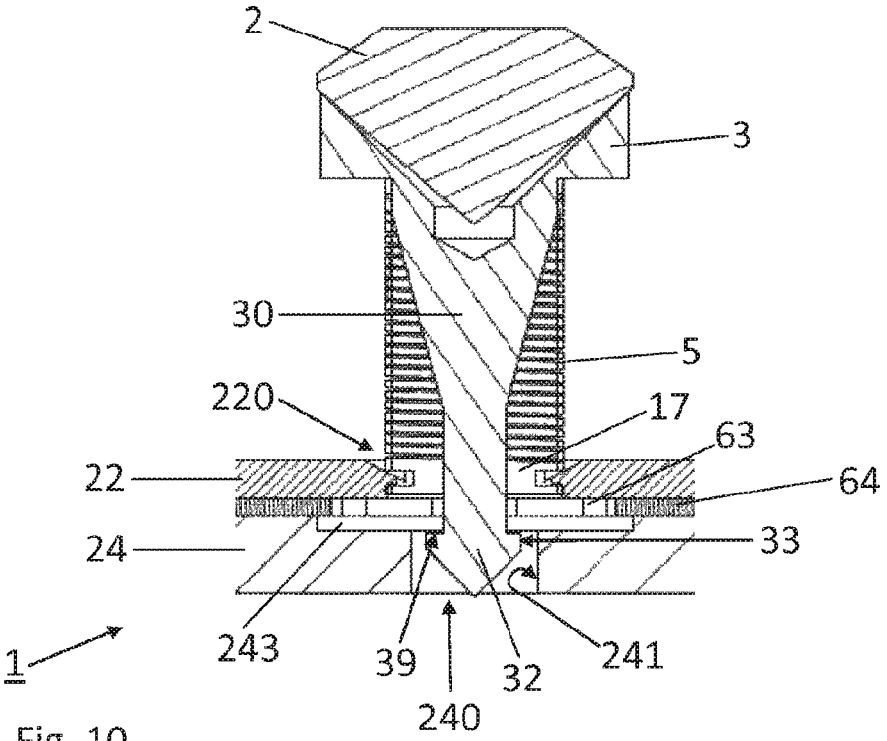
FIG. 10 represents a cross section view of the crimping system according to yet another embodiment.

In yet another embodiment illustrated in FIG. 10, a peg 30 extends distally from the crimping support 3 and comprises a distal head 32 at its distal extremity. The distal extremity 17 of the spring 5 is fastened to the item 6 by means of a distal fastening element comprising a first support element 22 extending radially from the distal extremity 17 of the spring 5. The distal fastening element also comprises a second support element 24 extending radially in a manner essentially parallel to the first support element 22. The second support element 24 comprises a second opening 240 in which the distal head 43 extends in an essentially concentric manner. In this configuration, when the crimping support 3 is subjected to shocks above said certain threshold, the distal head 32 of the peg stops against a second wall 241 of the second opening 240. In other words, the second wall 241 serves as a stop.

Figure 11A:
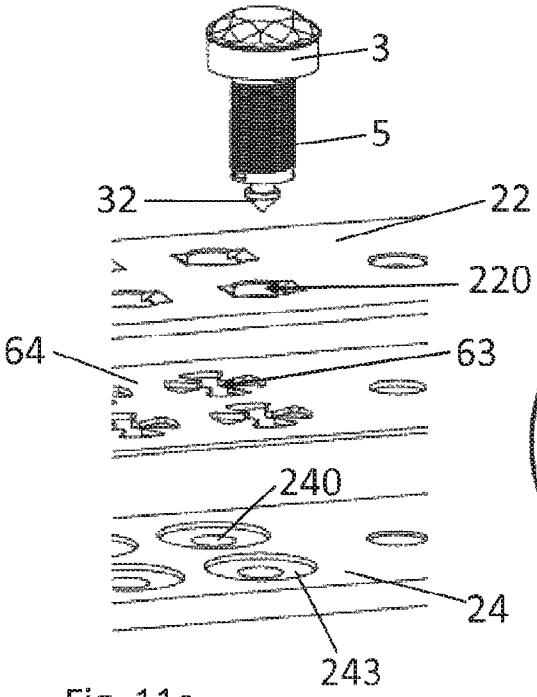
FIG. 11*a* shows different configurations of a flexible element of the crimping system and FIG. 11*b* shows a detail of an opening made in the flexible element, according to one embodiment.
Figure 11B:
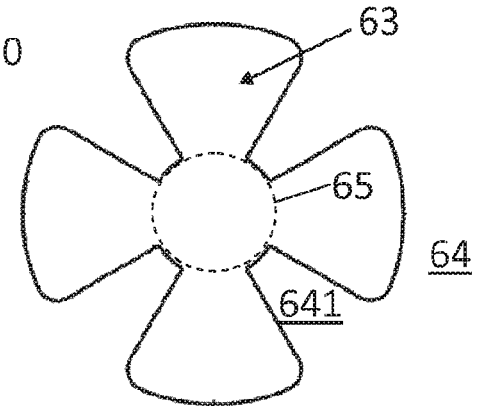

In a preferred configuration, a flexible element 64 is lodged between the first support element 22 and the second support element 24. The flexible element 64 comprises a flexible opening 63 that is concentric with the first opening 220 and with the second opening 240. FIG. 11*a* shows an exploded view of the crimping system 1 wherein the first support element 22, the flexible element 64 and the second support element 24 are visible individually. FIG. 11*b* shows an example of the quadrilobe shape that the flexible opening 63 can take. The distal head 32 has a diameter that decreases distally and its widest diameter 33 is greater than the diameter of the flexible opening 63 (shown by the dashed-line circle 65 in FIG. 11*b*).

In this configuration, the distal extremity 17 of the spring 5 can be arranged to be clipsed in a rigid fashion in the first support element 22. The distal head 32 passes through the flexible opening 63 and is lodged in the second opening 240. The flexibility of the flexible opening 63 makes it possible for the distal head 32 to pass through despite its diameter 33 being greater than the diameter 65 of the flexible opening 63. The axial displacement of the crimping support 3 upwards is limited by a flat section 39 of the distal head 32 which stops against the flexible element 64 (against the portions 641 between the lobes of the flexible opening 65 in the example illustrated in FIG. 11*b*). The second opening 240 can comprise a concentric housing 243 allowing a certain axial displacement of the flexible element 64 in said housing 243. The axial displacement of the crimping support 3 downwards is limited by the compression of the spires of the spring 5.

In a variant embodiment illustrated in FIGS. 11*a* and 11*b*, the opening 220 of the first support element 22 comprises a flange 222 having a diameter smaller than the maximum diameter 33 of the distal head 32. The first support element 22 can be sufficiently flexible for the distal head 32 to be inserted into the first opening 220 through the flange 222. Once the distal head 32 has passed through the opening 220, the axial displacement of the crimping support 3 upwards is limited by the flat section 39 stopping against the flange 222. FIG. 11*a* shows different possible configurations for the first opening 220 and the flange 222. FIG. 11*b* shows a detail of an opening 220 having a quadrilobe shape and whose parts 222 between the lobes play the role of the flange.

In other embodiments, the flexible element comprises a flat spring 50 extending radially from the crimping support 3. In the examples illustrated in FIGS. 4 and 5, the flexible element comprises a strip 51 comprising a plurality of flat springs 50, wherein each flat spring 50 is fastened to a crimping support 3 (with only one being represented in FIG. 5). The strip 51 is mounted on a first rigid support element 22 extending radially and capable of being fastened to the item 6 through fastening means including typically screws and nuts 224.

Each of the flat springs 50 can take the shape of a flat spiral spring or of a flexible membrane, for example of elastomer. The flat spring 50 can also comprise a helical spring, for example conical. The flat spring 50 enables the crimping support 3, and thus the stone 2, to oscillate or vibrate radially and axially by deformation of the spring 50 following a movement of the item 6.

Figure 5:
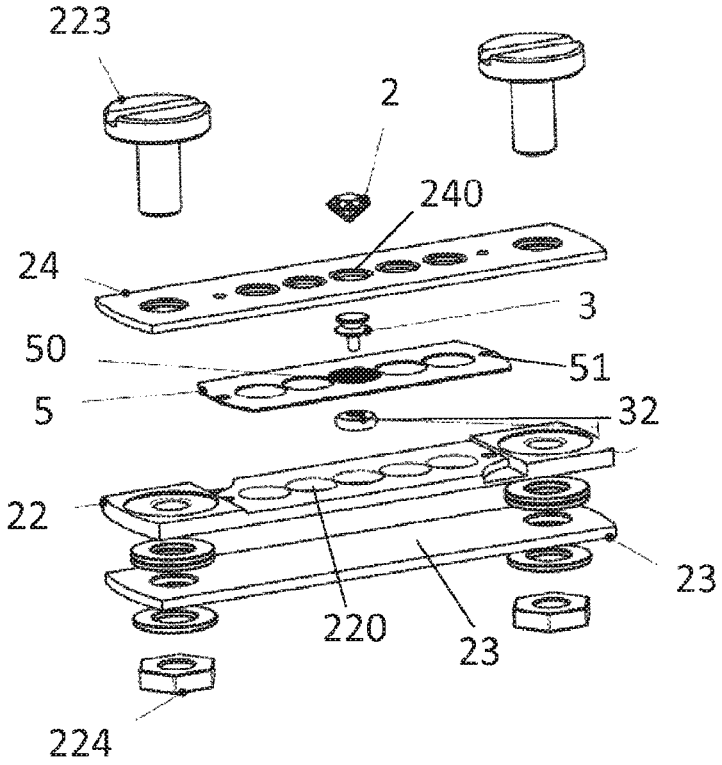
FIG. 5 illustrates an exploded view of the crimping system according to another embodiment.

In one embodiment, the radial movement of the stone 2 is limited by the crimping support 3 stopping against a stop element extending radially. In particular, the crimping system 1 comprises a second support element 24 extending radially above the first support element 22. The second support element 24 can be fastened to the first support element 22 through screws 223, such as illustrated in FIG. 5. The second support element 24 comprises a plurality of openings 240, each of the openings 240 being axially aligned with one of the crimping supports 3. In this configuration, the amplitude of the radial oscillation of the stone 2 is limited by the crimping support 3 stopping against the lateral wall of the opening 240.

Figure 4:
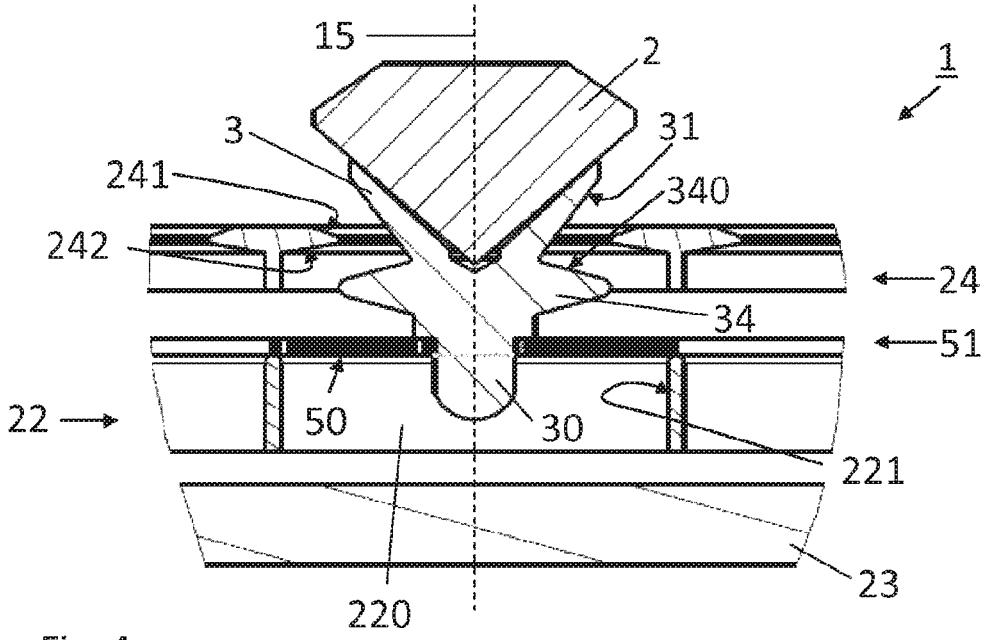
FIG. 4 illustrates a cross section view of the crimping system according to another embodiment.

In one advantageous variant embodiment illustrated in FIG. 4, the wall of the opening 240 comprises a first chamfer 241 provided on one of the faces of the second support element 24 so that when the stone 2 (mounted on its crimping support 3) oscillates, the inclined face 31 of the crimping support 3 comes to rest on the first chamfer 241.

In another variant embodiment illustrated in FIG. 4, the crimping support 3 comprises a proximal element 34 in the shape of a disc or bump generally extending radially from the crimping support 3 and comprising an inclined face 340. The proximal disc 34 is configured so that the inclined face 340 stops on the wall of the opening 240 so as to limit the radial movement of the stone 2. As illustrated in FIG. 4, the wall can also comprise a second chamfer 242 on the opposite side of the second support element 24, so that the inclined face 340 stops against the second chamfer 242.

Figure 6:
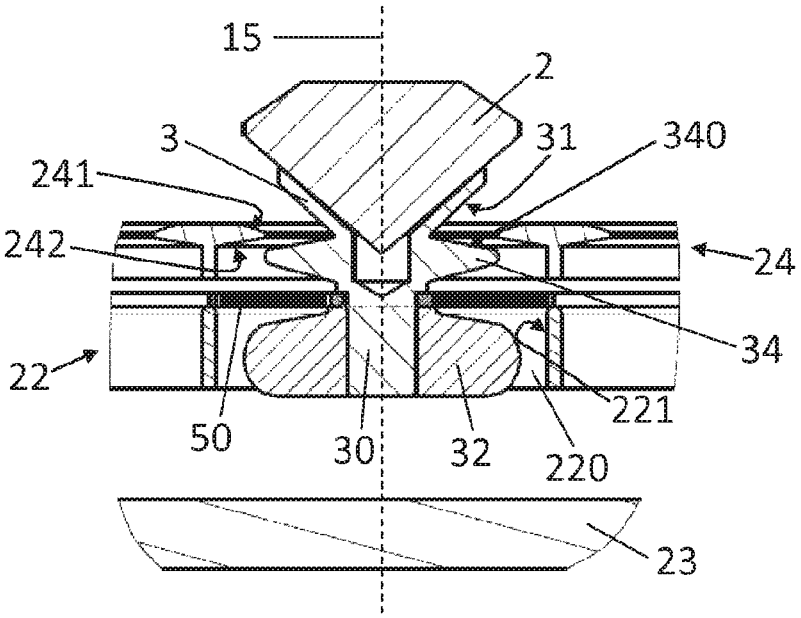
FIG. 6 shows the crimping support according to another embodiment.

In yet another embodiment shown in FIG. 6, the crimping support 3 comprises a peg 30 extending distally in the first support element 22. In this configuration, the radial movement of the stone 2 is limited by the peg 30 of the crimping support 3 stopping against the radial stop element. In particular, the first support element 22 comprises an opening 220 that is concentric with the crimping support 3 and extends axially below the flexible element 50. The flexible element 50 can be fastened to the crimping support 3 so that during the oscillation of the stone 2, the peg 30 oscillates in opposition with the stone 2. In such a configuration, during the oscillation of the stone 2, the peg 30 can stop against the wall 221 of the opening 220, limiting the radial movement of the stone 2. The wall 221 thus constitutes a radial stop element.

In one variant embodiment, the peg 30 comprises a distal element 32 in the shape of a disc or bump extending radially from a distal portion of the peg 30. When the stone 2 oscillates, the latter's radial movement will be limited by the distal disc 32 stopping against the wall 221 of the opening 220. The distal disc 32 can be made as a single piece with the crimping support 3 or as a distinct part that is subsequently fastened onto the peg 30 of the crimping support 3.

In another embodiment, the crimping system 1 also comprises an axial stop element 23 extending radially and centered on the axis of symmetry 15. The element 23 is fastened to the first support element 22 through the screws 223 below the latter, as illustrated in FIG. 4. During the axial displacement of the stone 2 towards below, the crimping support 3 stops against the axial stop element 23 and limits the amplitude of the axial movement of the stone 2. In the case where the crimping support 3 comprises the peg 30, it is the latter that stops against the axial stop element 23.

Figure 7:
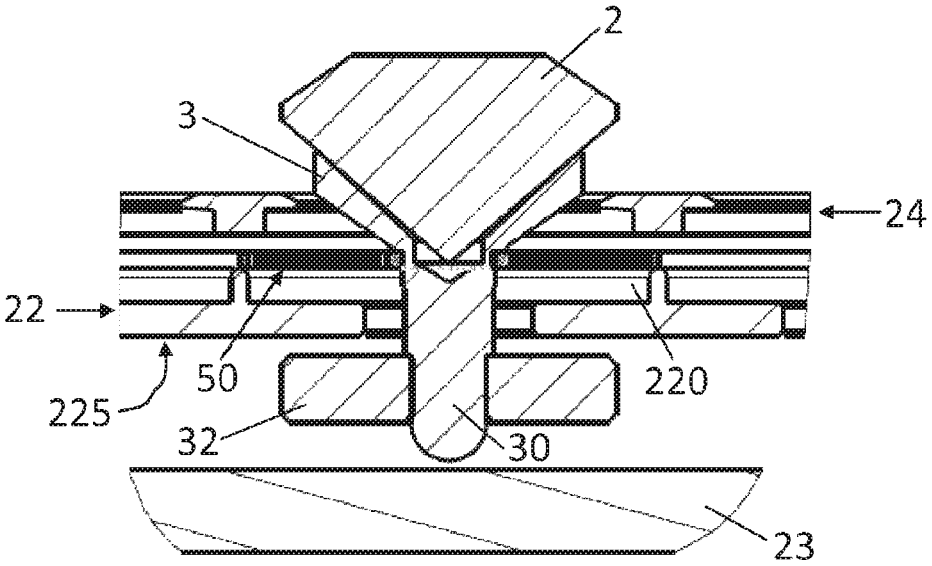
FIG. 7 represents the crimping support according to another embodiment.

In yet another embodiment illustrated in FIG. 7, the peg 30 of the crimping support 3 extends distally beyond the first support element 22, so that the distal disc 32 finds itself under the first support element 22. In this configuration, the distal disc 32 stops against the lower side 225 of the first support element 22 so as to limit the axial movement of the stone 2 (mounted in the crimping support 3) during an axial displacement of the stone 3 towards above.

According to another aspect of the variants of FIGS. 6 and 7, the disc or distal element 32 also has the function of unbalance, since it allows, by its sizing and its mass, the center of gravity of the oscillating elements (the stone 2 and the crimping support) to be positioned and thus to equilibrate and maintain this unit at a same inclination in vertical and horizontal position, under the effect of gravity.

As illustrated in FIG. 5, the crimping system 1 can comprise a plurality of crimping supports 3, or even a matrix of crimping supports 3 allowing for example a pattern to be represented. The crimping system 1 can of course also comprise a single crimping support 3.

Figure 12:
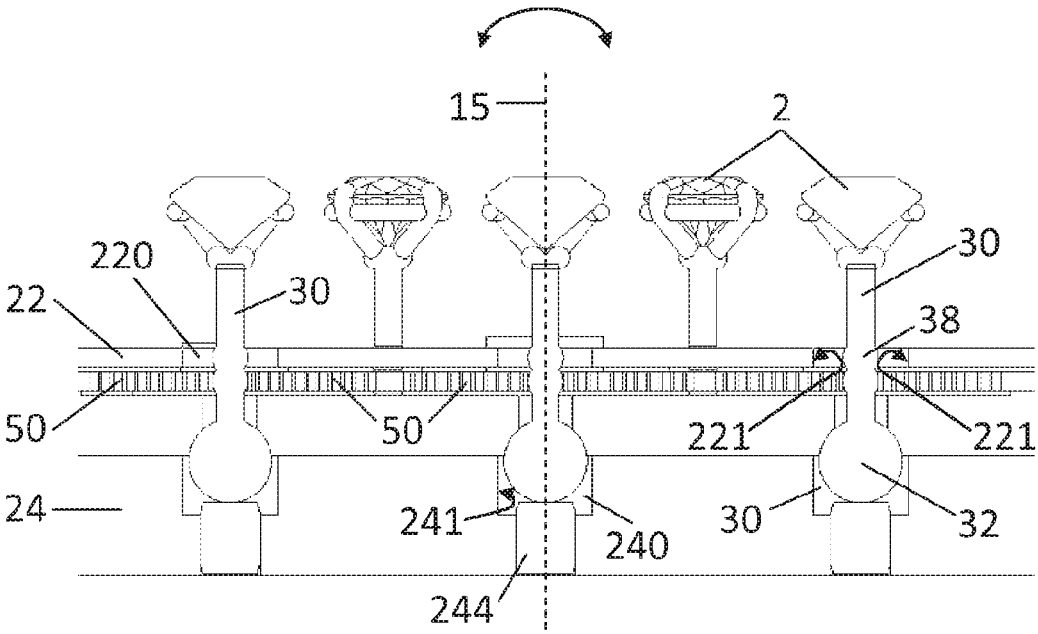
FIG. 12 illustrates a cross section view of a unit comprising a plurality of crimping systems, corresponding to another embodiment of the crimping systems.

In yet another embodiment illustrated in FIG. 12, the distal fastening element comprises a second support element 24. The peg 30 comprises a distal head 32 arranged to cooperate, in the manner of a ball-and-socket joint, with the wall 241 of a second opening, here in the form of a cavity 240 provided in the second support element 24. A flat spring 50 cooperates with the peg 30 at the level of an axial position 38, between the distal head 32 and the crimping support 3, so that the peg 30 and the crimping support 3 can oscillate around the distal head 32, relative to an axis of symmetry 15.

The distal fastening element also comprises a first support element 22 onto which the flat spring 50 is mounted. The first support element 22 comprises a first opening 220 through which the peg 30 passes. When the crimping support 3 is subjected to shocks above the threshold, the peg 30 stops between the axial position 38 and the crimping support 3 against a wall 221 of the opening 220.

The flat spring 50 can be a flat spiral spring or also a flexible membrane.

In a preferred embodiment, the crimping system 1 is fastened in a dial of a timepiece. The crimping system 1 can also be fastened on another part of the timepiece, on an item of jewelry or on eye glasses.

Advantageously, in the different variants described above, once the stone 2 is mounted in the crimping support 3, the elastic elements 5 and the stop elements cannot be perceived by the item's wearer and in no way negate the appearance of the item.

REFERENCE NUMBERS USED IN THE FIGURES

1 crimping system
10, 11 spires
12 cutaway
13 first extremity of the spring, proximal extremity of the spring
14 distal fastening element, pin
15 axis of symmetry
16 boring
17 second extremity of the spring, distal extremity of the spring
18 stop element, rod
19 recess, cavity
190 diameter of the recess
191 axial fins
192 distal diameter
2 precious stone
20 proximal extremity of the stop element
21 internal wall
22 first support element
220 first opening
221 radial stop element, wall of the first opening
223 screw
224 nut
225 lower side of the first support element
23 axial stop element
24 second support element
240 second opening, cavity
241 wall of the second opening, first chamfer
242 second chamfer
243 concentric housing
3 crimping support
30 peg
31 inclined face of the crimping support
32 disc or distal element, distal head
33 maximum diameter of the distal head
34 proximal disc
340 inclined face of the proximal disc
35 proximal head of the rod
36 maximum diameter of the proximal head
38 axial position
39 flat section
5 flexible element, spring
50 flat spring
51 band
6 timepiece or jewelry item
63 flexible opening
64 flexible element
641 portions
65 diameter of the flexible opening

7 profile
8 culasse of the precious stone
9 frontal part
$K_1$ first stiffness
$K_2$ second stiffness

The invention claimed is:

1. Crimping system for a timepiece or jewelry item comprising:

a crimping support;

a precious stone mounted in or on the crimping support; and a flexible element fastened to the crimping support in such a way as to flexibly link the crimping support to said item, such that the crimping support can oscillate axially and radially relative to an axis of symmetry, following a movement of the item;

the crimping system further comprising a stop that is more rigid than the flexible element, the stop being capable of cooperating with the crimping support, in such a way as to limit the range of axial and radial movement of the crimping support when the latter moves relative to the item, wherein the stop does not come into contact with the crimping support when the latter is in its resting position or when it is only subjected to shocks below a certain threshold.

2. Crimping system according to claim 1, wherein the flexible element is fastened to the peg and extends axially between the crimping support and the item.

3. Crimping system according to claim 1, wherein the stop comprises a rod also extending axially on at least part of the length of the flexible element and whose one extremity cooperates with the wall of the cavity.

4. Crimping system according to claim 3, wherein the wall comprises fins deformable radially and forming a distal opening; and wherein the rod comprises a proximal head having a diameter decreasing distally, wherein the largest diameter of the proximal head is smaller than the diameter of the cavity but greater than the diameter of the distal opening, so that the proximal head can be inserted into the cavity from the distal opening by deformation of the fins and, when inserted, the proximal head is configured to stop against the fins when the crimping support is subjected to shocks above said certain threshold.

5. Crimping system according to claim 1, wherein one distal extremity of the flexible element is fastened to the item by means of a distal fastening element.

6. Crimping system according to claim 5, wherein the distal fastening element comprises a first support element on which the flexible element is fastened, wherein the first support element comprises a first opening; and a second distal support extending radially in a manner essentially parallel to the first support element and comprising a second opening having a second wall serving as a stop.

7. Crimping system according to claim 6, wherein said portion of the peg comprises a distal head extending essentially concentrically in the second opening.

8. Crimping system according to claim 7, furthermore comprising a flexible element between the first support element and the second support element and comprising a flexible opening concentric with the first and second opening; and wherein the distal head has a diameter decreasing distally, the greatest diameter of the distal head being greater than the diameter of the flexible opening so that the distal head can stop against the flexible element so as to limit the axial displacement of the crimping support in a direction opposed to the item.

9. Crimping system according to claim 8, wherein the second wall comprises a first chamfer cooperating with an inclined face of the crimping support.

10. Crimping system according to claim 8, wherein the crimping support comprises a proximal element extending radially from the crimping support and comprising an inclined face; and wherein the second wall comprises a second chamfer cooperating with the inclined face of the proximal element.

11. Crimping system according to claim 8, wherein said portion of the peg comprises a distal head extending essentially concentrically in the first opening and cooperating with the first wall.

12. Crimping system according to claim 8, wherein the stop furthermore comprises an axial stop element capable of cooperating with the peg so as to limit the axial movement of the crimping support.

13. Crimping system according to claim 7, wherein the distal head cooperates with the wall of a second opening in the manner of a ball-and-socket joint;

wherein the spring cooperating with the peg at an axial position between the distal head and the crimping support, so that the peg and the crimping support can oscillate relative to an axis of symmetry around the distal head.

14. Crimping system according to claim 13, wherein the first wall cooperates with the peg, between the axial position and the crimping support.

15. Crimping system according to claim 6, wherein the flexible element comprises a flat spring extending radially from the crimping support.

16. Crimping system according to claim 15, wherein the flat spring is mounted on the first support element.

17. Crimping system according to claim 15, wherein the flat spring is a spiral spring.

18. Crimping system according to claim 1, wherein the flexible element comprises a cylindrical spring having the form of a tube and wherein the stop is lodged.

19. Crimping system according to claim 18, wherein the limitation of the amplitude of the axial movement towards the item is obtained by the compression of the spires of the spring.

20. Crimping system according to claim 18, wherein the distal fastening element comprises a pin extending axially and in which the distal extremity of the spring is fastened.

21. Crimping system according to claim 1, wherein the flexible element (5) and the stop(s) cannot be perceived by the wearer of the item when the stone is mounted in the crimping support.

22. Dial of a timepiece comprising a crimping system including a crimping support; a precious stone mounted in or on the crimping support; and a flexible element fastened to the crimping support in such a way as to flexibly link the crimping support to said item, such that the crimping support can oscillate axially and radially relative to an axis of symmetry, following a movement of the item; the crimping system further comprising a stop that is more rigid than the flexible element, the stop being capable of cooperating with the crimping support, in such a way as to limit the range of axial and radial movement of the crimping support when the latter moves relative to the item, wherein the stop does not come into contact with the crimping support when the latter is in its resting position or when it is only subjected to shocks below a certain threshold.

23. Timepiece or jewelry item comprising a crimping system including a crimping support; a precious stone mounted in or on the crimping support; and a flexible element fastened to the crimping support in such a way as to flexibly link the crimping support to said item, such that the crimping support can oscillate axially and radially relative to an axis of symmetry, following a movement of the item; the crimping system further comprising a stop that is more rigid than the flexible element, the stop being capable of cooperating with the crimping support, in such a way as to limit the range of axial and radial movement of the crimping support when the latter moves relative to the item, wherein the stop does not come into contact with the crimping support when the latter is in its resting position or when it is only subjected to shocks below a certain threshold.

24. Crimping system for a timepiece or jewelry item comprising:

a crimping support;

a precious stone mounted in or on the crimping support; and a flexible element fastened to the crimping support in such a way as to flexibly link the crimping support to said item, such that the crimping support can oscillate axially and/or radially relative to an axis of symmetry, following a movement of the item;

the crimping system further comprising a stop that is more rigid than the flexible element, the stop being capable of cooperating with the crimping support, in such a way as to limit the range of axial and/or radial movement of the crimping support when the latter moves relative to the item, wherein the stop does not come into contact with the crimping support when the latter is in its resting position or when it is only subjected to shocks below a certain threshold, wherein the crimping support comprises a peg extending distally from the support and whose at least one portion cooperates with the stop, wherein said portion of the peg comprises a cavity, the stop cooperating with a wall of the cavity.

* * * * *